United States Patent [19]

Maassen et al.

[11] Patent Number: 4,914,557

[45] Date of Patent: Apr. 3, 1990

[54] LUMINAIRE HAVING A LIGHT ABSORBING COLLAR

[75] Inventors: Egbertus J. P. Maassen; Franciscus A. M. M. Van Meel, both of Eindhoven, Netherlands

[73] Assignee: U.S. Philips Corporation, New York, N.Y.

[21] Appl. No.: 388,310

[22] Filed: Jul. 28, 1989

Related U.S. Application Data

[63] Continuation of Ser. No. 324,376, Mar. 16, 1989, abandoned.

[30] Foreign Application Priority Data

Mar. 31, 1988 [NL] Netherlands ..... 8800821

[51] Int. Cl.[4] ..... F24V 7/00

[52] U.S. Cl. ..... 362/305; 362/304; 362/346; 362/350

[58] Field of Search ..... 362/255, 305, 304, 347, 362/348, 350, 346, 349

[56] References Cited

U.S. PATENT DOCUMENTS

| | | | |
|---|---|---|---|
| 1,210,039 | 12/1916 | Brennecke | 362/255 |
| 4,545,000 | 10/1985 | Fraley et al. | 362/348 |
| 4,855,886 | 8/1989 | Eijkelenboom et al. | 362/350 |

FOREIGN PATENT DOCUMENTS

| | | | |
|---|---|---|---|
| 16225 | of 1912 | United Kingdom | 362/350 |
| 523215B | 7/1940 | United Kingdom . | |

*Primary Examiner*—Carroll B. Dority
*Attorney, Agent, or Firm*—Brian J. Wieghaus

[57] ABSTRACT

The luminaire comprises a cup-shaped reflector having facets which are curved continuously and extend from the light emanating aperture of the reflector towards the reflector axis. The facets of the reflector, in planes transverse to the reflector axis, are straight and constitute a regular polygon. The luminaire further comprises a circumferential light-absorbing collar which has a portion which narrows from the reflector edge in a stepwise manner. The luminaire together with an axially accommodated light source provides a wide, homogeneous, sharply bounded beam and at small angles with the axis. It is no longer observable as a source of light.

13 Claims, 1 Drawing Sheet

LUMINAIRE HAVING A LIGHT ABSORBING COLLAR

This is a continuation application Ser. No. 324,376, filed Mar. 16, 1989 and now abandoned.

BACKGROUND OF THE INVENTION

The invention relates to a luminaire having a concave reflector with an axis of symmetry and a circumferential edge transverse to said axis which bounds a light emanating aperture. The reflector comprises elongate facets which extend from the light emanating aperture towards the reflector axis of symmetry.

A lamp holder is accommodated on the axis of symmetry opposite to the light emanating aperture of the reflector. The lamp holder receives an electric lamp which has an elongate light source and secures the lamp with light source extending substantially axially in the reflector.

Such a luminaire is known from GB 523 215-B. The reflector of the said luminaire has facets whch are also concave transversely to their longitudinal direction. At the level of the light source the reflector has a circumferential bend. The reflector forms a light beam which illuminates a radiated object uniformly. However, the beam is rather narrow so that comparatively large objects cannot be illuminated with one luminaire and neither can comparatively small objects which are present at a comparatively small distance from the luminaire. In order to avoid this drawback the known luminaire would have to be made too bulky to be useful for practical purposes.

Another drawback of the known luminaire is that it also radiates light at comparatively large angles with the axis, which light does not contribute to the light flux of the beam but does betray the place where the luminaire is accommodated.

U.S. Application Ser. No. 128,757 filed Dec. 4, 1987, now U.S. Pat. No. 4,855,886, discloses a bowl-shaped reflector having a plurality of elongate facets which are parabolically curved in the direction of the focal axis but which have a cross-section which is straight. This reflector provides a broader beam for illuminating objects than the reflector disclosed in GB 523 215-B but does not provide a beam as sharply bounded as desired.

SUMMARY OF THE INVENTION

It is the object of the invention to provide a luminaire of the type described in the opening paragraph which provides a comparatively wide, sharply bounded beam with which an object can be illuminated uniformly while the luminaire radiates substantially no light beyond the boundary of the beam. A particular object of the invention is to provide such a luminaire which has comparatively small dimensions.

According to the invention this object is achieved in that the reflector is cup-shaped, its facets are curved continuously in the longitudinal direction while in crosssections transverse to the axis of symmetry, they form a regular polygon, and the luminaire, outside the reflector has a circumferential light-absorbing collar which has a first portion which narrows from the circumferential edge of the reflector stepwise to a diameter smaller than the light emanating aperture, and has a subsequently widening second portion.

The said luminaire provides a wide sharply bounded beam in which the light is uniformly distributed, also in the case it has comparatively small dimensions. Beyond the boundary of the beam the luminaire radiates substantially no light so that for an observer who is beyond the beam and observes the luminaire at a comparatively small angle with the axis, the luminaire can no longer be recognised as a source of light.

Due to its cup shape the reflector provides a wide beam which as a result of the facets which are uncurved transversely to the longitudinal direction provides an illuminated area of great uniformity. The beam width, measured between places where the light intensity is 50% of the maximum light intensity, is, for example, approximately $2\times12°$ to $2\times45°$, also depending on the dimensions of the light source of the lamp used in the luminaire.

The circumferential light-absorbing collar prevents not only that the luminaire is observable as a source of light for an observer who is beyond the beam, the collar also prevents, due to its stepped shape, that radiation which is incident thereon and which is not absorbed, is reflected to certain places of the light source and hence disturbs the thermal balance of the light source. Since substantially no material has a coefficient of absorption 1, said non-absorbed radiation may comprise visible radiation in addition to the IR radiation. It has proved favourable that the stepped narrowing first portion of the circumferential collar has surfaces which extend substantially parallel and substantially transversely, respectively, to the axis of the reflector.

The widening second portion of the circumferential collar may be more or less conical. An attractive alternative is a second portion which widens stepwise. A collar thus formed hides the presence of the luminaire even better since it intercepts radiation, if any, which is scattered by the first portion to the second portion.

A variety of types of electric lamps may be used in the luminaire, for example, a high-pressure sodium vapour discharge lamp, for example, having a colour temperature of 2400 K. or more. Other possibilities are a halogen incandescent lamp having a linear or a compactly folded, axially accommodated filament, or a high-pressure metal halide lamp.

The overal lengths of the said electric lamps may vary considerably and hence the distance from the lamp holder to the light emanating aperture. As a result of this the length of the lamp may essentially influence the dimension of the luminaire in the axial direction. Nevertheless, said dimension will as a rule not exceed the value of 25 cm. The axial dimension of the reflector and its circumferential collar together will generally be smaller than 10 cm with a largest inside diameter of, for example, 15 cm. Said axial dimension includes, for example, 1.5 to 4 cm of the circumferential collar.

The uniformity of the illumination which the luminaire provides may even be further increased by preventing unreflected light from leaving the luminaire. For that purpose means may be present which intercept unreflected light. Since the light source is placed substantially axially in the luminaire, however, the share of the generated light which could leave the luminaire unreflectedly without the said means is small. Said means, for example a screen, may be connected to the luminaire. However, they may otherwise be supported alternatively by the electric lamp which is used in the luminaire. An impervious coating on the end of the lamp envelope remote from the lamp cap or the outer envelope of the lamp may be used. Another possibility is a cap which is placed on the lamp envelope or the outer envelope of the lamp.

BRIEF DESCRIPTION OF THE DRAWINGS

An embodiment of the luminaire according to the invention is shown in the drawing, in which.

DESCRIPTION OF THE PREFERRED EMBODIMENT

Figure 1:
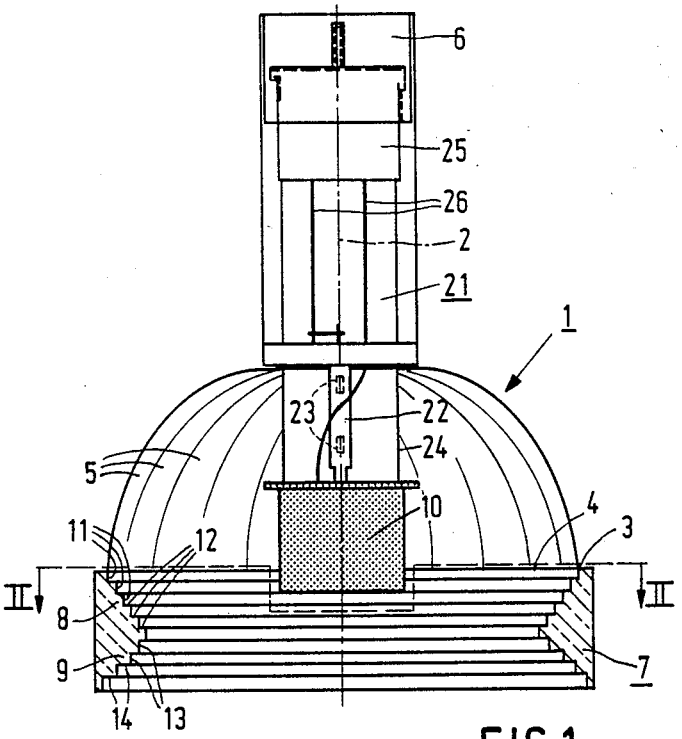
FIG. 1 is a side elevation, partly an axial sectional view of a luminaire with a lamp provided therein.

The luminaire in FIG. 1 has a concave reflector 1 having an axis of symmetry 2 and a circumferential peripheral edge 3 transverse to the axis of symmetry 2 which bounds a light emanating aperture 4. The reflector 1 has elongate facets 5 which extend from the peripheral edge 3 towards the axis 2. A lamp holder 6 is accommodated on the axis of symmetry 2 opposite to the light emanating aperture 4 to receive an electric lamp 21 which has an elongate light source 22, said light source 22 extending substantially axially in the reflector 1.

Figure 2:
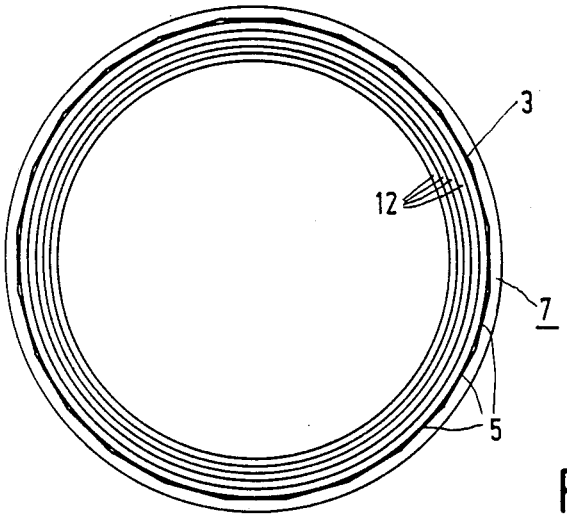
FIG. 2 is a sectional view taken on the line II—II in FIG. 1.

The reflector 1 is cup-shaped. Its facets 5 are curved continuously in the longitudinal direction. In cross-sections tranverse to the axis of symmetry 2 they constitute a regular polygon (FIG. 2). Outside the reflector 1 the luminaire has a circumferential light-absorbing collar 7 which has a first portion 8 which narrows from the circumferential edge 3 of the reflector 1 stepwise to a diameter smaller than the light emanating aperture 4 and comprises a subsequently widening second portion 9.

A high pressure sodium vapour discharge lamp 21 is accommodated in the luminaire in which a discharge vessel 22, filled with sodium vapour and having electrodes 23, constitutes an elongate light source which consumes a power of 50 W and has a colour temperature of 2500 K. The discharge vessel 22 is accommodated in an outer envelope 24 which supports a lamp cap 25. Current supply conductors 26 extend from the lamp cap 25 to the discharge vessel 22.

The luminaire has means to intercept unreflected rays on their way to the light emanating window, i.e. a cap 10 which is placed on the outer envelope 24 and is kept in its place thereby.

The stepped narrowing first portion 8 of the collar 7 which consists, for example, of aluminium or acrylate which is colored dark with paint, for example black, or consists of a homogeneous, for example black, synthetic resin body which is dull at its surface, has surfaces 11 which extend substantially parallel to the axis 2, for example, enclose an angle therewith between 0° and 5°, and surfaces 12 which extend substantially transversely to the axis 2, for example are perpendicular to the surfaces 11. In the embodiment shown the widening second portion 9 is also stepped. The surfaces 13 and 14 extend at similar angles to the axis 2 as the surfaces 11 and 12 respectively.

In the embodiment shown the reflector has a largest diameter of approximately 125 mm and a largest height of approximately 53 mm and the facets 5 are uniformly curved in their longitudinal direction according to a curve II which satisfies the coordinates of table 1. The axis of symmetry 2 is denoted by y=0. Alternative curves for a reflector of similar dimensions are, for example, the curves I and III of table 1 and other similar curves which are between the curves I and III.

TABLE 1

| curve I | | curve II | | curve III | |
|---|---|---|---|---|---|
| x coord. | y coord. | x coord. | y coord. | x coord. | y coord. |
| 0 | 16 | 0 | 16.0 | 0 | 16 |
| 1.5 | 20.3 | 1.5 | 23.3 | 1.5 | 26.3 |
| 4.0 | 26.2 | 4.0 | 30.4 | 4.0 | 34.6 |
| 7.6 | 32.4 | 7.6 | 37.0 | 7.6 | 41.6 |
| 12.9 | 37.6 | 12.9 | 42.8 | 12.9 | 48.0 |
| 18.9 | 43.7 | 18.9 | 46.7 | 18.9 | 49.7 |
| 25.3 | 48.4 | 25.3 | 50.6 | 25.3 | 52.8 |
| 32.0 | 52.6 | 32.0 | 54.0 | 32.0 | 55.4 |
| 38.9 | 56.3 | 38.9 | 57.1 | 38.9 | 57.9 |
| 45.8 | 59.4 | 45.8 | 59.8 | 45.8 | 60.2 |
| 53.0 | 62.1 | 53.0 | 62.2 | 53.0 | 62.3 |
| 54.1 | 62.5 | 54.1 | 62.5 | 54.1 | 62.5 |

With the lamp shown which has an electrode spacing of 17 mm the reflector provides a uniformly illuminated area having a clear boundary at an angle of 2×26° viewed from the lamp position. At an angle of approximately 40° with the axis the luminaire is no longer recognisable as a source of light. The light which is generated by a light source placed essentially axially on the luminaire is effectively converted into a beam by the luminaire.

What is claimed is:

1. A light fixture, comprising:

a reflector defining a focal axis, said reflector having an opening centered on the focal axis for receiving a light-source and a concave reflective surface terminating at a peripheral edge of said reflector opposite to said opening; and a collar disposed at said peripheral edge, said collar having a circumferentially extending portion having a light absorbing surface extending stepwise from said peripheral edge radially inward and axially away from said opening and terminating at a diameter smaller than said peripheral edge.

2. A light fixture as claimed in claim 1, wherein said collar portion has stepped surfaces which extend substantially parallel to and substantially transversely to, respectively, said reflector axis.

3. A light fixture as claimed in claim 1, wherein said collar comprises an additional portion having a light absorbing surface facing away from said reflecting surface which extends from said smaller diameter stepwise radially outward and axially away from said light source opening.

4. A light fixture, comprising:

a bowl-shaped reflector having an opening for receiving a light source and a reflecting surface defining a focal axis extending from said opening to a peripheral edge of said reflector opposite said opening, said reflecting surface comprising a plurality of contiguous elongate facets each curving continuously from said opening to said peripheral edge, the cross-section in planes normal to said focal axis of the reflecting surface of each facet is a straight line, and the straight line cross-sections of said facets defining a regular polygon; and a collar disposed at said peripheral edge, said collar having a circumferentially extending portion with a light absorbing surface facing said reflecting surface and extending stepwise from said peripheral edge radially inward and axially away from said light source opening and terminating at a diameter smaller than said peripheral edge.

5. A light fixture as claimed in claim 4, wherein said first portion of said collar has stepped surfaces which extend substantially parallel to and substantially transversely to, respectively, said focal axis.

6. A light fixture as claimed in claim 5, wherein said said collar comprises an additional portion having a light absorbing surface facing away from said reflecting surface which extends stepwise from said smaller diameter radially outward and axially away from said light source opening.

7. A luminaire comprising:

a light source having an elongated light emitting portion defining a principal axis; and a bowl-shaped reflector having an opening for receiving said light source and a reflecting surface defining a focal axis extending from said opening to a peripheral edge of said reflector opposite said opening, said reflecting surface comprising a plurality of contiguous facets each curving continuously from said opening to said peripheral edge, the cross-sections in planes normal to said focal axis of the reflecting surface is a straight line, and the straight line cross sections of said plurality of facets defines a regular polygon;

a lamp holder for holding said light source with said principal axis aligned with said focal axis; and a light absorbing collar disposed at said peripheral edge, said collar having a circumferentially extending portion having a light absorbing surface facing said reflecting surface and extending stepwise from said peripheral edge radially inward and axially away from said light source opening and terminating at a diameter smaller than said peripheral edge.

8. A light fixture as claimed in claim 7, wherein said first portion of said collar has stepped surfaces which extend substantially parallel to and substantially transversely to, respectively, said reflector axis.

9. A light fixture as claimed in claim 8, wherein said said collar comprises an additional portion having a light absorbing surface facing away from said reflecting surface which extends from said smaller diameter stepwise radially outward and axially away from said light source opening.

10. A luminaire as claimed in claim 9, further comprising intercepting means for intercepting unreflected light rays from said light source.

11. A luminaire as claimed in claim 10, wherein said intercepting means comprises a shield covering the end of said light source closest to said collar.

12. A luminaire as claimed in claim 8, further comprising intercepting means for intercepting unreflected light rays from said light source.

13. A luminaire as claimed in claim 7, further comprising intercepting means for intercepting unreflected light rays from said light source.

* * * * *